United States Patent [19]

Fukuoka

[11] 4,109,661

[45] Aug. 29, 1978

[54] FOOTWEAR

[76] Inventor: Tatsuo Fukuoka, No. 3-3, 2-chome, Shinminamifukushima, Tokushima-chi, Japan

[21] Appl. No.: 738,579

[22] Filed: Nov. 3, 1976

[30] Foreign Application Priority Data

| | | | |
|---|---|---|---|
| Nov. 14, 1975 | [JP] | Japan | 50-155738[U] |
| Nov. 21, 1975 | [JP] | Japan | 50-158859[U] |
| Dec. 25, 1975 | [JP] | Japan | 50-177168[U] |
| Jun. 2, 1976 | [JP] | Japan | 51-72358[U] |

[51] Int. Cl.[2] ..... A61F 5/14

[52] U.S. Cl. ..... 128/582; 36/11.5

[58] Field of Search ..... 128/582, 581, 25 B; 36/11.5

[56] References Cited

U.S. PATENT DOCUMENTS

| | | | |
|---|---|---|---|
| 1,867,679 | 7/1932 | Riehle et al. | 128/581 X |
| 1,981,379 | 11/1934 | Thomson et al. | 128/25 B |
| 2,486,653 | 11/1949 | Hukill | 128/582 |
| 3,103,931 | 9/1963 | Knellwolf | 128/582 |
| 3,299,893 | 1/1967 | Collina | 128/581 |
| 3,595,244 | 7/1971 | Kugler | 128/582 |
| 3,612,043 | 10/1971 | Inaki | 128/582 X |
| 3,722,113 | 3/1973 | Birkenstock | 36/11.5 |
| 3,757,774 | 9/1973 | Hatuno | 128/25 B |

FOREIGN PATENT DOCUMENTS

| | | | |
|---|---|---|---|
| 2,430,651 | 1/1976 | Fed. Rep. of Germany | 128/25 B |

*Primary Examiner*—John D. Yasko

*Attorney, Agent, or Firm*—Browdy and Neimark

[57] ABSTRACT

Footwear is provided with pressure projections in the inside thereof for locally stimulating vital points distributed on the skin of the foot. Each of said pressure projections is composed of a pressure projection body and a projection core attached at the upper portion of the pressure protection body. The projection core is relatively hard and the pressure projection body is softer than said core attached at the upper portion of the pressure projection body. When wearing this footwear, the projection bodies press on vital points of the feet, and the projection cores on the upper portion of the body stimulate locally the vital points of the feet, and due to both of these actions a comfortable and pleasant wearing feeling is obtained.

21 Claims, 16 Drawing Figures

FOOTWEAR

FIELD OF THE INVENTION

The present invention relates to footwear providing a comfortable wearing feeling and more particularly to footwear which can press and stimulate vital points of the feet thereby resulting in a comfortable wearing feeling.

BACKGROUND OF THE INVENTION

"Vital point" as referred to in the present specification and claims is called "Tsubo" in Japanese and means a vital point for oriental therapy, as shown in FIG.1 with respect to vital points of the foot, and discussed hereinbelow.

In general, the oriental medical science has actually proven that abnormalities of the body can be regulated to normal state by giving some stimulation to the vital points. A means for giving stimulation to a vital point which is most generally carried out is to press the vital point by the thumb or other four fingers or by the whole of the palm of the hand. When the vital point is finger pressed, the flow of the as it is referred to "Keiraku", as it is referred to in the oriental medical science, becomes good,so that various diseases can be treated, and this is the basic principle of the oriental medical science. The Keiraku means the circulatory system which gives energy to Rokuzo Rokufu (main viscera) during the circulation therethrough, Rokuzo Rokufu being the important parts for the life of humans. Rokuzo means the liver, the heart, the spleen, the lungs, the kidney and shinpo, and Rokufu means the gall bladder, the small intestines, the stomach, the colon, the bladder and sansho. The body of humans is controlled by these Rokuzo and Rokufu, and when a trouble occurs in these viscera, the condition of the body may get out of order.

The vital points of the foot exist at positions fairly far away from the viscera, but it has been proven by the oriental medical science that stimulation to the vital points is very effective for the viscera, such as stomach and so on, and from the principle of the modern circulatory physiology, the blood circulation of the fingers and toes, namely, the peripheral circulatory dynamic condition is very delicate, and if the blood circulation of these parts is normal, the hands and feet are warm, and when the vital points are stimulated, the blood circulation of the entire body, particularly the breast and abdomen are, regulated thereby resulting in removing of various conditions of diseases, and this has been proven by experiments carried out for many years.

With regard to the vital points distributed on the foot, the positions of the vital points distributed on the sole of the foot of Ingamn-si-observation are shown in FIG. 1. In FIG. 1, the vital point 1 relates to the eye, and 2 to the lungs and the bronchial tubes, and the Yusen of the vital point 3 to the suprarenal body, and the vital point 4 to the heart, and 5 to the kidney, the heart and blood pressure, 6 to the suprarenal body, 7 to the waist and sexual organs, 8 to the colon, 9 to the spinal cord reflex part, and 10 to the kidney respectively, and when these vital points are subject to pressure stimulation, this may have effects on the respective parts. For example, if the Yusen part of the vital point 3 is subject to pressure stimulation, a medical treatment to the related part may be expected.

SUMMARY OF THE INVENTION

An object present invention is to provide footwear which has pressure projections on the inside thereof, whereby the vital points of the soles of the feet may be pressure stimulated merely by wearing it, so that the peripheral circulatory dynamic condition may be changed and more blood may be supplied to the feet resulting in so called "cool head and warm foot" condition which is most favorable to the health, and which provides comfortable wearing feeling and also the good effects of the medical treatment for various diseases, particularly, chronic diseases and semihealth syndrome which are difficult to completely cure by the western medical science, and thus has superior effects for the improvement of health and the treatment and prevention of diseases.

According to the present invention, the pressure projection of the footwear is composed of a pressure projection body and a projection core, and said core is attached at the upper portion of said projection body so as to pressure stimulate the vital point directly or indirectly relatively close thereto, and said projection body is softer than the core so that the projection body presses the vital point through elasticity of said projection body, and accordingly the vital point can be effectively pressure stimulated by the pressure projection merely by wearing the footwear with the result that semihealth syndrome and various chronic diseases can be fundamentally cured.

An important object of the present invention is to provide such footwear as mentioned above.

Another important object of the present invention is to provide footwear which is able to pressure stimulate vital points effectively and also gives comfortable wearing feeling to a wearer.

The footwear of the present invention is provided with pressure projections for locally pressing the surface the skin of the feet and each of these pressure projections is composed of a pressure projection body and a projection core fixed at the upper portion of the projection body.

The pressure projection is generally provided on the sole surface of the footwear, but it may be provided on the side of the footwear. The pressure projection body may be formed integrally with the footwear or it may be formed in a matting member, and in the latter case the members are inserted into the footwear to compose the footwear of the present invention. The present invention may be adaptable to all footwear such as shoes, sandals, slippers and so on.

The pressure projection body is generally formed from a soft body, and particularly preferable, from a soft synthetic resin foam body, and the material of the projection body preferably has temperature dependent characteristics in which it becomes soft with increasing temperature and hard with lowering temperature. The pressure projection body may be formed integrally with the footwear or may be buried in the footwear, or it may be formed in a matting member and this member is inserted into the footwear during fabrication thereof. The material of the projection body may be the same as that of the footwear or may be quite different from that of the footwear. When the projection body is formed integrally with the footwear, if the sole is too soft, a little harder member is used for the sole, and this member is formed with a throughhole, and only the projecting portion of the projection body is projected out through the through-hole from the interior of the footwear thereby allowing the integral formation of the projection body with the footwear. This pressure projection body is of a gentle mountain shape, but in some cases, it may be of a sharp-angled mountain shape or a very gentle mountain shape. All that is required is to cause a desirable pressing condition within the footwear.

The pressure projection is composed of a projection body and a projection core attached at the upper portion thereof. The core is made of a hard material, which is generally selected from the group consisting of hard synthetic resin, semihard resin, gold, silver, platinum, copper, nickel, iron, stainless steel, other alloys and magnet members etc. The shape of the core is usually an obtuse conical shape which is able to stimulate the surface of the skin moderately.

The projection core is inserted fixedly or removably in an attaching hole formed in the pressure projection body.

As described above, the pressure projections composed of pressure projection bodies and projection cores thereon are provided at positions in the footwear corresponding to parts where a number of vital points of the feet are subject to pressure stimulation. The projections are provided on at least one, and, if possible, preferably on all, of the particularly important parts, such as the root parts of the toes, the arch of the foot part, Yusen part existing a little toward the toes from the arch and to the center portion, and the center part of the heel.

DETAILED DESCRIPTION OF PREFERRED EMBODIMENTS

Figure 1:
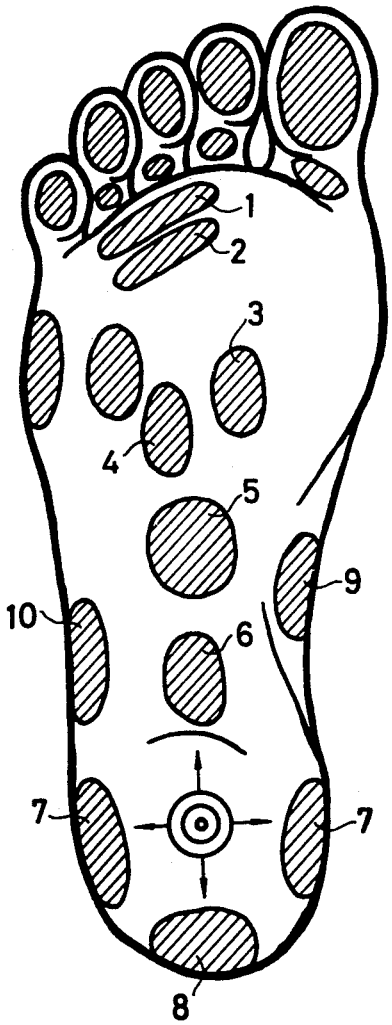
FIG. 1 is an Ingamu-si-observation drawing showing main vital points of the sole of a foot.
Figure 2:
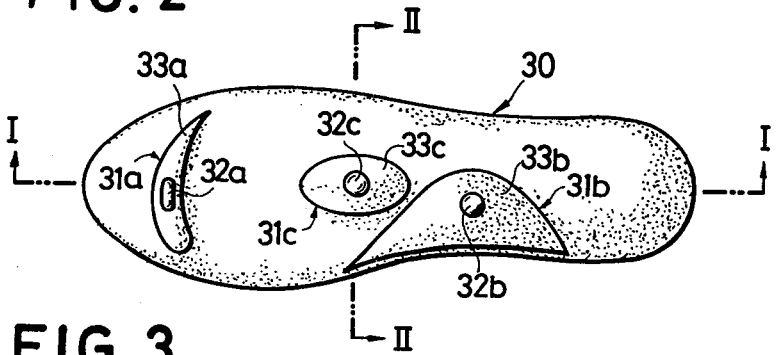
FIG. 2 is a plan view showing the sole of an embodiment of a footwear according to the present invention.
Figure 3:
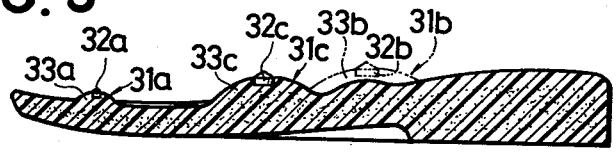
FIG. 3 is a longitudinal sectional view taken along the line I—I in FIG. 1.
Figure 4:
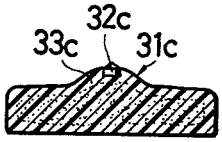
FIG. 4 is a cross-sectional view taken along the line II—II in FIG. 1.

An embodiment is shown in FIGS. 2 through 4, wherein a sole 30 is provided with a crescent-shaped pressure projection 31*a* at the root part of the toes, a semicircular pressure projection 31*b* at the arch of the foot part, and an elliptical pressure projection 31*c* at Yusen part in the center of the arch of the foot immediately behind the bulge of the big toe which is a little to the forward and central portion off the arch of the foot part. These pressing projections 31*a*, 31*b* and 31*c* have respectively core members 32*a*, 32*b* and 32*c* at the upper portions thereof.

The pressure projection comprises a pressure projection body a pressure core, the core being hard and the projection body being softer than the core. The projection core is mounted at the upper portion of the pressure projection body so as to allow effective pressure stimulation to the vital points of the foot. Each of pressure projections 31*a*, 31*b* and 31*c* are constructed such that a projection core 32*a*, 32*b* and 32*c* is attached at the top of a pressure projection body 33*a*, 33*b* and 33*c* respectively with the tips of the cores projecting above the surface of the pressure projection bodies. The projection core is made of a material, such as hard or semihard synthetic resin, metal, magnet and all other materials like these, which has such a hardness as to allow it to pressure stimulate the vital points of the foot effectively, and it is formed in the form of a conical, cylindrical, or disc-shaped body, or prism-shaped or plate-shaped body, or egg-shaped or spherical body. The upper face of the core member which pressure stimulates the skin of the foot is formed in the form of a center convex pyramidal shape to improve the pressure stimulation effect. The pressure projection body is formed in a suitable shape at a use position by a material at least softer than the core member, preferably one that has an elasticity which is enough for causing deformation by pressing by hand or treading by foot, for example, such as soft synthetic resin or its foam, or rubber like elastic such as natural or synthetic rubber etc.

The shape, height and pliability of the pressure projection body changes according to which vital point of the foot is to be pressure stimulated. In the case of the pressure projections shown in FIGS. 2 through 4, a preferable height of the pressure projections at the root part of the toes, the arch of the foot part and Yusen part is about 2-8mm when the pressure projections are formed from, for example, soft synthetic resin integrally with the sole.

As described above, in the case where a crescent-shaped pressure projection is provided at the root part of the toes, the projection engages with the toes when walking with the footwear, so that the footwear is prevented from slipping out of the feet even if it is such a one that is easy to slip out, such as sandals.

Figure 5:
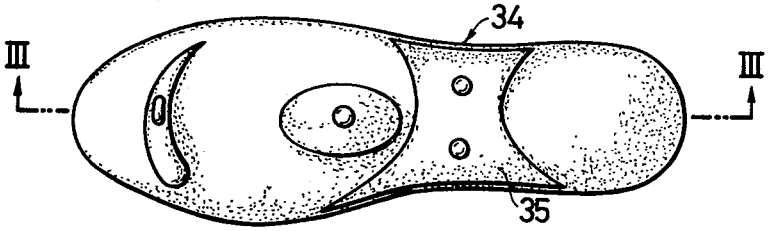
FIG. 5 is a plan view showing the sole of another embodiment of a footwear according to the present invention.

In a sole 34 shown in FIG. 5, the pressure projection 35 at the arch of the foot part is formed in an elongate form crossing the bottom at the center thereof, and this pressure projection 35 can pressure stimulate the whole center part of the foot including the arch of the foot part, and the projection 35 is of such shape that it has an equivalent effect to that effected by treading a half blue bamboo split into two and a plurality of vital points distributed on the arch of the foot part can be pressure stimulated all together.

There are many vital points in the recessed part of the foot. Accordingly, the pressure projection is formed in the form of, for example, a mountain shape so as to allow it to effectively press the recessed part such as the arch of the foot part or the root part of the toes. A pressure projection for pressing near the root of the five toes has an elongate mountain shape which projects from the bottom, as a whole. However, the pressure projection according to the present invention is not always projected from the inside of a footwear A reason for this is that the pressure projection is adapted to pressure stimulate the vital point in the foot part and accordingly includes one that can pressure stimulate a local part of the foot only when treading on the footwear. Namely it includes one wherein the hardness of the pressure projection body is harder than that surrounding the projection body and upon treading on or near the pressing projection, the surrounding portion of said projection is pushed down thereby causing it to be substantially projected outwardly, and also one wherein the upper face of the pressure projection curves with a convex center portion, but the radius of curvature thereof is larger than that of the foot face which contacts the pressure projection so that the foot contacts the pressure projection locally in point contact relation or in a relatively small area resulting so that the pressure projection can pressure stimulate the foot with a stronger force than that applied to the other part, namely assuming that the foot face is plane, the pressure projection projects upwardly from the inside of the footwear. In these cases, the pressure projection does not always project out of a footwear under the usual condition where the footwear is not worn. However, the pressure projection can pressure stimulate the vital point of the foot with a stronger force than that applied to another part.

A sole 30 shown in FIGS. 2 through 4 has pressure projection bodies 33 formed integrally with the sole 30 made of synthetic resin, and near the tops of the projection bodies core members 32 are fixed therein respectively. The sole having the pressure projection bodies integrally formed therewith from soft synthetic resin can be easily produced, and also the soles having the pressure projections at certain positions can be produced in mass production.

Figure 6:
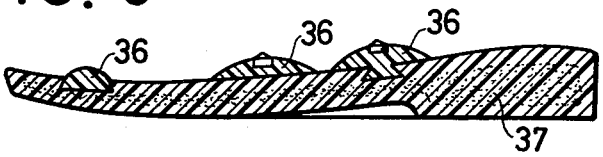
FIG. 6 is a longitudinal sectional view taken along the line III—III in FIG. 1.

The present invention is not limited to the embodiment wherein the sole and the pressure projection bodies are integrally formed, but includes the forms such as for example, as shown in FIG. 6, in which the pressure projection bodies 36 are separate members from the sole 37 and these separate projection bodies 36 are attached to the sole 37, and in such a case, the pressure projections can be easily attached to a prior art footwear base having a flat surface thereon.

Figure 7:
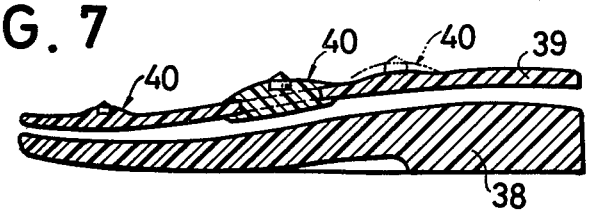
FIG. 7 is a longitudinal sectional view showing a further embodiment of a footwear according to the present invention with a matting member inserted therein.

The pressure projection bodies can be attached the upper face of a footwear base by means of a double side adhesive tape or magic band etc. In the case where the pressure projection is attached on the upper face of the sole, the pressure projection is, in principle, attached to the sole itself, but in the case where the sole 38 has on the upper face thereof a matting member 39 or an inside matting or an inside bottom etc. as shown in FIG. 7, it is possible to provide pressure projections 40 in this matting member 39. A simple method to provide pressure projections in a matting member is one wherein the matting member is formed from a synthetic resin which is softer than the core members and the pressure projections are formed integrally with the matting member. The matting member of such construction can be easily laid on a prior art footwear as it is, and since the matting member 39 does not require a strength as does the sole, it can be regulated to a most desirable pliability as the pressure projection. Alternatively, the pressure projection body is made as a separate one from the matting member and this body is fixed to the matting member.

Figure 8:
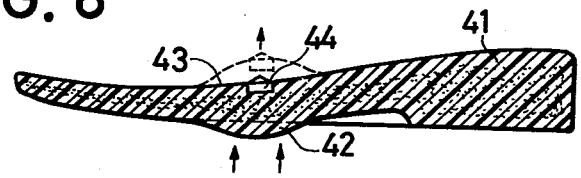
FIG. 8 is a longitudinal sectional view of the sole of a further embodiment of a footwear according to the present invention.

A sole 41 shown in FIG. 8 is one wherein a projection 42 projects from the underside of the pressure projection body of the sole 41 and when at least a portion around the projection 42 of the sole 41, preferably all the sole 41 is trodden by foot, since it has flexibility enough to allow it to deform so as to project on the upper side of the footwear base, the pressure projection body 43 formed integrally with the sole 41 projects upward whereby the projection core 44 pressure stimulates the sole of the foot.

Figure 9:
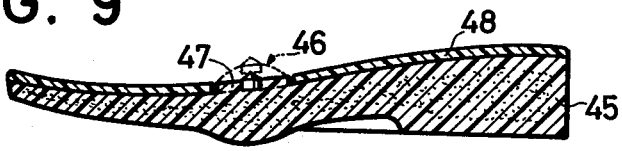
FIG. 9 is a longitudinal sectional view of the sole of a further embodiment of a footwear according to the present invention.

FIG. 9 shows a sole construction in which all the sole 45 is formed from a soft synthetic resin and a relatively hard surface member 48 is laid on the sole, said surface member having through-holes 47 only at positions where the pressure projections 46 project out of the surface member. The sole of this construction allows the pressure projections to be projected out only at positions of the through-holes 47.

Figure 10:
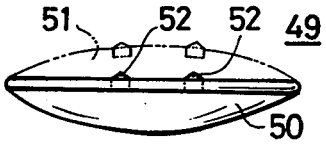
FIGS. 10 and 11) are cross-sectional views of the soles of further embodiments according to the present invention, having soft projections on the undersides of the soles respectively.

A sole 49 shown in FIG. 10 is formed with a large projection 50 on approximately all over the underside of the sole 49, and all the sole 49 has pliability. As a result, when the sole 49 is trodden by foot, all the sole 49 bends downward, whereby the pressure projection body 51 formed integrally with the sole at the center portion of the sole projects out and the core members 52 locally pressure stimulate mainly all the arch of the foot part. The sole of such shape has the same effect as that obtained when treading a blue bamboo by the arch of the foot part, and can pressure stimulate a plurality of vital points dotted on the arch of the foot part altogether.

Figure 11:
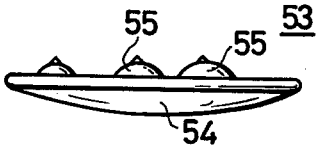

A sole 53 shown in FIG. 11 has a projection 54 on the underside thereof and pressure projections 55 on the upper side of the sole 53, and has pliability, so that when the sole 53 is trodden by foot, the sole is deformed and thereby the pressure projections on the upper side are pushed up due to the projection 54 on the bottom thus resulting in increase of the pressing force of the pressure projections 55. The sole of such shape can heighten the pressing effect of the pressure projections even with small and low pressure projections provided on the upper side thereof.

A sole as shown in FIGS. 8 through 11 is provided with a projection on the underside of the sole and has pliability at least at positions where pressure projections of the sole are provided, so that when the sole is trodden by foot the pressure projections project upwardly out of the surface of the sole. Such a sole can be worn easily and smoothly because the pressure projections do not interfere when wearing it, and a higher pressing effect may be expected by enlarging the projection at the bottom, and even if a larger projection is formed at the bottom, it is unnecessary to change the size of the shell leather or the band because said projection lies on the underside of the bottom, and even if a pressure projection of any shape and size is provided at any position of the bottom, the bottom and shell leather or band can always fit the foot, and when treading the bottom by foot, the pressure projection projects out to stimulate the foot thus resulting in a higher pressing effect.

If the pressure projection body is formed from a soft material having temperature dependent characteristics such that it becomes pliable with increasing temperature and harder with lowering temperature, for example, a synthetic rubber such as chloroprene rubbers, butylene rubber and so on, or a soft synthetic resin such as vinyl chloride, EVA and so on and soft synthetic resin foam body etc., the pressure projection becomes harder in winter when it is cold and the skin of the foot becomes stiff and its sense becomes dull and also the pressure stimulation effect decreases because of wearing thick socks, thereby effecting pressure stimulation to the vital points of the foot with a stronger force. On the contrary, in summer when it is hot and the sense of the foot becomes sensitive and a footwear is worn by bare feet or with thin socks, the pressure projection becomes more pliable and the pressure stimulating force becomes weakened, so that from cold winter to hot summer all through the year, an optimum pressing effect and comfortable wearing feeling may be always obtained. Also, since the adjustment of the pressure stimulation of the pressure projection corresponding to the temperature may be effected due to the temperature dependent characteristics of the pressure projection, the adjusting mechanism of the pliability is quite simple and the pliability may be always adjusted to the optimum value.

The vital points are not always distributed on the sole of the foot, and accordingly the pressure projection is not always provided on the footwear base, but it may be provided on the shell leather of shoes or the band of sandals.

Figure 12:
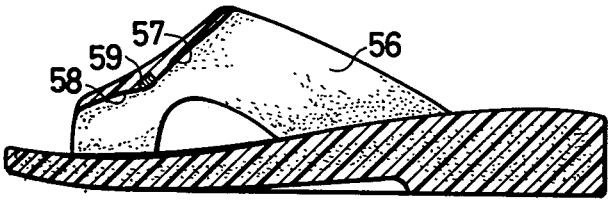
FIG. 12 is a longitudinal sectional view of slippers of a further embodiment according to the present invention.

FIG. 12 shows sandals which are provided with a pressure projection 57 on the band 56, wherein the pressure projection body 58 is formed integrally with the band 56 from a soft synthetic resin foam body and a projection core 59 is fixed at the top of said projection body so as to project out of the surface of the projection body 58.

Figure 13:
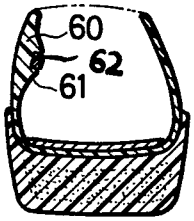
FIG. 13 is a cross-sectional view of the heel portion of shoes, with a pressure projection provided on the side thereof.

FIG. 13 is a cross-sectional view of the heel portion of shoes, in which the shell leather 60 is formed from a soft synthetic resin, and a pressure projection body 61 projects inside the shell leather and is formed integrally with the shell leather, and a core member 62 is forced in the center portion of the pressure projection. The pressure projection of the shell leather pressure stimulates, for example, Kinmon (chin-men) of Bladder Meridian (Pan-Kung-ching) located in the depression in the lower front of the outer ankle. In the case where the pressure projection attaching portion of the shell leather is formed from a soft synthetic resin, the pressure projection which is a separate member from the shell leather may be fixed to the shell leather by means of, for example, adhesives etc.

Figure 14:
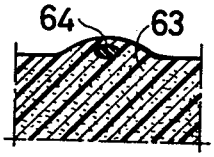
FIGS. 14, 15 and 16 are partly cross-sectional views showing various fixing conditions of the projection cores respectively.

In the case where the projection core is fixed to the pressure projection body with the former projecting out of the surface of the latter as shown in FIGS. 2 and 4, the projection core directly pressure stimulates a vital point of the skin face of the foot, so that the highest pressure stimulating effect may be expected. The present invention relates to the pressure stimulation to vital points of the feet by means of the projection cores, but the projection cores are not always necessary to project out of the surfaces of the pressure projection bodies, and the present invention includes the embodiments wherein a core material 64 is buried in the upper portion of the pressure projection body 63, for example, as shown in FIG. 14. In the case that the projection core is buried in the pressure projection, it is preferably buried at a position of a depth within 5mm from the surface of the pressure projection so that the vital point of the foot can be effectively pressure stimulated by the core member through the pressure projection body. In general, one pressure projection body has one projection core attached thereto, but it is of course possible to attach a plurality of projection cores to one pressure projection body.

Figure 15:
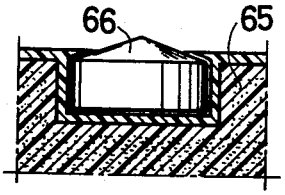

In the case that the pressure projection body is formed from a soft synthetic resin, a most simple method to fix a projection core to said projection body is such one that when forming a pressure projection body 65, an attaching cavity for fixing a core member 66 is formed by means of a metal mold, and after forming the sole, the projection core 66 is force fitted in said cavity, as shown in FIG. 15.

Figure 16:
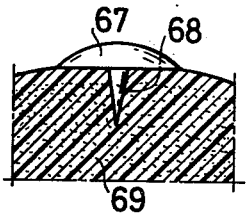

The projection core may be attached, for example, by adhesives or screw, or in such a manner that a pin 68 is provided on the underside of a core member 67 as shown in FIG. 16 and this pin 68 is pressed in the pressure projection body 69.

Also, in the case where the projection core is buried in the pressure projection body, the projection core may be inserted in the pressure projection while said projection is molded from synthetic resin.

In the case where an attaching cavity for the projection core is formed in the pressure projection body, a projection core member is easily pushed therein, and in this case, the projection core is formed in any shape preventing falling off during use, and most generally it is formed in a cylindrical shape having a desired height, and on the other hand, the attaching cavity formed in the pressure projection body is formed in a cylindrical shape having the same diameter as the outside diameter of the projection core or a diameter a little smaller than said outside diameter, and a projection core made of magnet etc. is formed so as to closely contact to the inside face of the attaching hole. If the attaching hole is formed so that the opening portion of the hole is slightly contracted in the form of so-called under cut shape, the periphery of the opening portion can prevent the projection core 66 from falling off, so that the peripheral side of the projection core is not always necessary to be contacted to the attaching hole closely.

If the periphery of the pressure projection body is closely contacted to the projection core, the gap between the projection core and the pressure projection body is removed thereby preventing any foreign matter from getting therebetween. In the case where a projection core is attached in the sole, this projection core may be always pushed in the attaching hole, so that in normal use conditions of the footwear the projection core does not fall off easily even if it is not completely fixed in the attaching hole. If the projection core is only inserted in the attaching hole without adhesives, it may be easily exchangeable. Accordingly, in this case, if a plurality of attaching holes for fixing the projection cores are provided in the pressure projection bodies, it is possible to displace the projection cores or remove them according to their use and positions of vital points at user's will. If the vital point differs, its effect will also differ, so that the above is desirable. In the case where the projection is attached into an attaching hole through the elasticity of the pressure projection body, the projection core can be very easily attached at a determined position only by pressing it in an attaching hole without any deflection from the determined position, and after attachment thereof, it is tightly held by the elasticity of the pressure projection, so that the fixing force applied to the projection core does not decrease in a short time as is the case of the use of adhesives.

In a preferred embodiment, the pressure projection body is formed from a soft synthetic resin foam body.

The diameter of a vital point has been known from clinical cases to be 2–3mm $\phi$, so that if the projection core is fixed correctly opposite to this vital point, the size of the projection core is sufficiently 2–3mm $\phi$. However, the position of the vital point differs a little according to individuals. Accordingly, in order to allow the projection core to pressure stimulate the vital point a little displaced according to individuals, the projection core is generally formed in the size of 0.5–1.5cm $\phi$ although it differs according to the attaching positions. When the area of the upper face of the projection core is broad, it is unnecessary to determine exactly the correct attaching position of the core member, so that positioning of the core member at the time of attaching thereof is easy.

What is claimed is:

1. An article of footwear including a bottom portion having at least one pressure projection for pressing against a part of the skin surface of the foot of the wearer of the footwear, each said pressure projection comprising a pressure projection body and a pressure core attached in the pressure projection body, said pressure projection body being softer than said projection core, and said projection core being relatively hard and fixed at the upper portion of said pressure projection body.

2. Footwear as claimed in claim 1, wherein said bottom portion comprises a sole and wherein said pressure projection is provided on the upper face of said sole of the footwear.

3. Footwear as claimed in claim 2, wherein said sole is formed from a soft synthetic resin which is softer than said projection core, and said pressure projection body is formed integrally with sole.

4. Footwear as claimed in claim 1, wherein said bottom portion includes a sole and a matting member laid thereon wherein said pressure projection is provided in said matting member.

5. Footwear as claimed in claim 4, wherein said matting member is formed from a softer synthetic resin than said projection core, and said pressure projection body is formed integrally with said matting member.

6. Footwear as claimed in claim 1, wherein the article of footwear is a sandal and said bottom portion comprises a sole having a band thereon and wherein said pressure projection is provided on the inside of said band.

7. Footwear as claimed in claim 6, wherein at least the neighborhood of said pressure projection in said band of the sandal is formed from a soft synthetic resin, and said pressure projection body is formed integrally with said band formed from synthetic resin.

8. Footwear as claimed in claim 1, wherein the article of footwear is a shoe and said bottom portion comprises a sole and a leather shell, and wherein said pressure projection is provided on the inside of said leather shell.

9. Footwear as claimed in claim 1, wherein said pressure projection body is a separate member from said bottom portion, and the pressure projecting body is fixed to said bottom portion.

10. Footwear as claimed in claim 1, wherein said projection core is selected from a group consisting of hard synthetic resin, semihard resin, metal and magnet.

11. Footwear as claimed in claim 1, wherein said pressure projection body is formed with an attaching hole in the upper surface thereof for said projection core, and said projection core is removably inserted into said attaching hole, such that the upper portion of said projection core protrudes from said projection body.

12. Footwear as claimed in claim 1, wherein said pressure projection body is formed with an attaching hole in the upper surface thereof for said projection core, and said projection core is inserted into the attaching hole and adhered therein, such that the upper portion of said projection core protrudes from said projection body.

13. Footwear as claimed in claim 1, wherein said pressure projection body has temperature dependent characteristics so that it becomes softer with increasing temperature and harder with lowering temperature.

14. Footwear as claimed in claim 1, wherein said pressure projection body is a soft synthetic resin foam.

15. Footwear as claimed in claim 1, wherein said pressure projection is provided on the upper surface of said bottom portion opposite the root part of the toes when worn.

16. Footwear as claimed in claim 1, wherein said bottom portion a sole and an insert above said sole of a material harder than said sole, said insert having a hole therethrough, and wherein said pressure projection is on said sole and projects out through the hole in said insert.

17. Footwear as claimed in claim 1, wherein said pressure projection is disposed on the footwear such as to press against at least one part of the skin surface of the foot of the wearer corresponding to a vital point of the foot.

18. Footwear as claimed in claim 1, wherein the upper face of said projection core is substantially convex.

19. Footwear as claimed in claim 1 wherein said pressure projection is provided on the upper surface of said bottom portion opposite the arch of the foot when worn.

20. Footwear as claimed in claim 1 wherein said pressure projection is provided on the upper surface of said bottom portion opposite the Yusen part, existing a little toward the toes from the arch and toward the center portion of the foot when worn.

21. Footwear as claimed in claim 1 wherein said pressure projection is provided in the upper surface of said bottom portion opposite the center part of the heel when worn.

* * * * *